US007243788B2

(12) United States Patent
Schmidt et al.

(10) Patent No.: US 7,243,788 B2
(45) Date of Patent: Jul. 17, 2007

(54) PACKAGE FOR SEGREGATING AND MIXING SUBSTANCES

(75) Inventors: Paul R. Schmidt, Neenah, WI (US); Nefetari B. Murph, Tucker, GA (US); Michael S. Brunner, Roswell, GA (US); Jack Lindon, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 190 days.

(21) Appl. No.: 10/691,726

(22) Filed: Oct. 22, 2003

(65) Prior Publication Data

US 2005/0087457 A1 Apr. 28, 2005

(51) Int. Cl.
*B65D 25/08* (2006.01)

(52) U.S. Cl. ..... 206/221; 206/219

(58) Field of Classification Search ..... 206/219, 206/221, 222; 383/63, 65; 215/DIG. 8; 422/120, 122; 239/55, 57, 60
See application file for complete search history.

(56) References Cited

U.S. PATENT DOCUMENTS

| | | | | | |
|---|---|---|---|---|---|
| 2,626,833 | A | * | 1/1953 | Valentine | 239/56 |
| 2,916,197 | A | * | 12/1959 | Detrie et al. | 206/219 |
| 2,971,850 | A | * | 2/1961 | Barton | 426/61 |
| 3,636,922 | A | | 1/1972 | Ketner | 118/264 |
| 3,796,245 | A | * | 3/1974 | Wildensteiner | 604/255 |
| 3,804,077 | A | | 4/1974 | Williams | |
| 3,950,158 | A | | 4/1976 | Gossett | 62/4 |
| 3,983,994 | A | * | 10/1976 | Wyslotsky | 206/219 |
| 4,057,047 | A | | 11/1977 | Gossett | 126/263 |
| 4,067,313 | A | | 1/1978 | Donnelly | 126/263 |
| 4,106,478 | A | | 8/1978 | Higashijima | 126/263 |
| 4,140,409 | A | | 2/1979 | DeVries | 401/132 |
| 4,254,910 | A | | 3/1981 | Martin | 239/60 |
| 4,277,024 | A | * | 7/1981 | Spector | 239/36 |
| 4,462,224 | A | | 7/1984 | Dunshee et al. | 62/530 |
| 4,487,801 | A | | 12/1984 | Turnbull et al. | 428/313.5 |
| 4,528,226 | A | | 7/1985 | Sweeny | 428/40 |
| 4,534,509 | A | | 8/1985 | Holzner | 239/34 |
| 4,547,381 | A | | 10/1985 | Mason et al. | 426/316 |
| 4,567,613 | A | | 2/1986 | Meehan | 4/209 R |
| 4,589,145 | A | | 5/1986 | Van Erden et al. | 383/5 |

(Continued)

FOREIGN PATENT DOCUMENTS

| | | |
|---|---|---|
| JP | 2000-191053 | 11/2000 |

(Continued)

*Primary Examiner*—David T. Fidei
(74) *Attorney, Agent, or Firm*—Schwegman, Lundberg, Woessner, & Kluth, P.A.

(57) ABSTRACT

The present invention relates to a package that includes an enclosure having a first substance and a second substance within the enclosure. The package further includes a plastic zipper which segregates the first substance from the second substance within the enclosure such that opening the plastic zipper allows the first substance and the second substance to be mixed together inside the enclosure. In another aspect, the package includes a gas-permeable enclosure and first and second solid substances stored within the enclosure. A mechanism, such as a plastic zipper, segregates the first and second solid substances. Opening the mechanism allows a user to mix the first and second solid substances inside the enclosure to produce a gas. The package permits the gas that is produced to permeate through the gas-permeable enclosure for distribution throughout an area.

10 Claims, 4 Drawing Sheets

U.S. PATENT DOCUMENTS

| | | | | | |
|---|---|---|---|---|---|
| 4,608,043 | A | | 8/1986 | Larkin | 604/87 |
| 4,633,533 | A | | 1/1987 | Meehan | 4/222 |
| 4,634,614 | A | | 1/1987 | Holzner | 428/35 |
| 4,643,725 | A | | 2/1987 | Schlesser et al. | 604/306 |
| 4,666,441 | A | | 5/1987 | Andriola et al. | 604/897 |
| 4,689,169 | A | | 8/1987 | Mason et al. | 252/186.24 |
| RE32,513 | E | * | 10/1987 | Seaber et al. | 239/6 |
| 4,720,417 | A | | 1/1988 | Sweeny et al. | 428/201 |
| 4,780,117 | A | | 10/1988 | Lahey et al. | 62/4 |
| 4,781,924 | A | | 11/1988 | Lee et al. | 424/449 |
| 4,798,288 | A | | 1/1989 | Holzner | 206/222 |
| 4,807,300 | A | | 2/1989 | Ausnit et al. | 383/65 |
| 4,812,067 | A | | 3/1989 | Brown et al. | 401/132 |
| 4,837,027 | A | | 6/1989 | Lee et al. | 424/449 |
| 4,895,135 | A | | 1/1990 | Hamasaki | 126/263 |
| 4,911,707 | A | | 3/1990 | Heiber et al. | 424/449 |
| 4,917,820 | A | * | 4/1990 | Matsumoto et al. | 252/397 |
| 4,921,636 | A | | 5/1990 | Traas | 252/408.1 |
| RE33,299 | E | | 8/1990 | Sweeny et al. | 428/201 |
| 4,998,671 | A | * | 3/1991 | Leifheit | 239/44 |
| 5,007,529 | A | | 4/1991 | Spector | 206/0.5 |
| 5,009,308 | A | | 4/1991 | Cullen et al. | 206/204 |
| 5,046,608 | A | | 9/1991 | Laipply | 206/209 |
| 5,048,692 | A | | 9/1991 | Handler et al. | 206/618 |
| 5,064,422 | A | | 11/1991 | Wick | 604/307 |
| 5,087,273 | A | * | 2/1992 | Ward | 96/147 |
| 5,117,809 | A | | 6/1992 | Scaringe et al. | 126/263 |
| 5,143,048 | A | | 9/1992 | Cheney, III | 126/263 |
| 5,164,178 | A | | 11/1992 | Muysson | 424/76.4 |
| 5,170,886 | A | | 12/1992 | Holzner | 206/0.5 |
| 5,174,462 | A | | 12/1992 | Hames | 220/87.1 |
| 5,220,909 | A | | 6/1993 | Pickard et al. | 126/263 |
| 5,234,162 | A | | 8/1993 | Sullivan | 239/56 |
| 5,248,537 | A | | 9/1993 | Giannavola | 428/40 |
| 5,305,733 | A | | 4/1994 | Walters | 126/263 R |
| 5,380,110 | A | | 1/1995 | Festa | 401/132 |
| 5,395,047 | A | * | 3/1995 | Pendergrass, Jr. | 239/56 |
| 5,465,707 | A | | 11/1995 | Fulcher et al. | 126/263.08 |
| 5,466,465 | A | | 11/1995 | Royds et al. | 424/449 |
| 5,468,447 | A | | 11/1995 | Bermas | 422/5 |
| 5,492,675 | A | | 2/1996 | Brizard | 422/122 |
| 5,534,020 | A | | 7/1996 | Cheney, III et al. | 607/108 |
| 5,558,874 | A | | 9/1996 | Haber et al. | 424/402 |
| 5,603,729 | A | | 2/1997 | Brown et al. | 604/114 |
| 5,611,329 | A | | 3/1997 | Lamensdorf | 126/263.07 |
| 5,624,478 | A | | 4/1997 | Patapanian et al. | 96/108 |
| 5,631,300 | A | | 5/1997 | Wellinghoff | 514/772.3 |
| 5,637,401 | A | | 6/1997 | Berman et al. | 252/315.2 |
| 5,639,295 | A | | 6/1997 | Wellinghoff et al. | 106/15.05 |
| 5,662,096 | A | | 9/1997 | Walters | 126/263.03 |
| 5,667,798 | A | | 9/1997 | Royds et al. | 424/449 |
| 5,668,185 | A | | 9/1997 | Wellinghoff | 514/772.3 |
| 5,695,814 | A | | 12/1997 | Wellinghoff et al. | 427/213 |
| 5,705,092 | A | | 1/1998 | Wellinghoff et al. | 252/187.21 |
| 5,707,739 | A | | 1/1998 | Wellinghoff et al. | 428/403 |
| 5,772,959 | A | | 6/1998 | Bermas | 422/5 |
| 5,782,409 | A | | 7/1998 | Paul | 239/56 |
| 5,885,701 | A | | 3/1999 | Berman et al. | 428/212 |
| 5,899,382 | A | | 5/1999 | Hayes et al. | 239/56 |
| 5,902,433 | A | | 5/1999 | Becher et al. | 156/209 |
| 5,915,461 | A | | 6/1999 | Tanhehco | 165/46 |
| 5,919,477 | A | | 7/1999 | Bevan et al. | 424/448 |
| 5,957,605 | A | | 9/1999 | Cohen et al. | 401/132 |
| 5,996,782 | A | | 12/1999 | Sperry et al. | 206/219 |
| 6,007,264 | A | | 12/1999 | Koptis | 401/132 |
| 6,030,122 | A | | 2/2000 | Ramsey et al. | 383/61 |
| 6,132,748 | A | | 10/2000 | Khanna et al. | 424/405 |
| 6,159,497 | A | | 12/2000 | LaPrade et al. | 424/448 |
| 6,162,457 | A | | 12/2000 | Martz | 424/448 |
| 6,286,670 | B1 | | 9/2001 | Smith | 206/221 |
| 6,289,889 | B1 | | 9/2001 | Bell et al. | 126/263.07 |
| 6,298,984 | B1 | | 10/2001 | Weaver et al. | 206/222 |
| 6,346,143 | B1 | | 2/2002 | McGowan | 96/117.5 |
| 6,352,210 | B1 | | 3/2002 | Requejo | 239/34 |
| 6,360,477 | B1 | | 3/2002 | Flashinski et al. | 43/131 |
| 6,393,843 | B2 | | 5/2002 | Kohout | 62/4 |
| 6,513,516 | B2 | | 2/2003 | Sabin et al. | 126/263.01 |
| 2002/0056830 | A1 | * | 5/2002 | Klatte | 252/187.23 |
| 2003/0116452 | A1 | * | 6/2003 | Saric et al. | 206/219 |

FOREIGN PATENT DOCUMENTS

| | | |
|---|---|---|
| WO | WO-87/01565 | 3/1987 |
| WO | WO-91/07996 | 6/1991 |
| WO | WO-91/10102 | 7/1991 |
| WO | WO-9505327 A1 | 2/1995 |
| WO | WO-00/29311 | 5/2000 |
| WO | WO-01/68155 | 12/2001 |
| WO | WO-02/38192 | 5/2002 |
| WO | WO-02/38193 | 5/2002 |
| WO | WO-02/38194 | 5/2002 |
| WO | WO-02/064877 | 8/2002 |
| WO | WO-02/067677 | 9/2002 |
| WO | WO-02/089862 | 11/2002 |
| WO | WO-03/000162 | 1/2003 |
| WO | WO-03/002425 | 1/2003 |

* cited by examiner

PACKAGE FOR SEGREGATING AND MIXING SUBSTANCES

FIELD

The present invention relates to a package and more particularly to a package that segregates two substances until a user decides to mix the substances.

BACKGROUND

There are many different types of packages available to store substances. Most conventional packages store a single substance while a few packages are adapted to store more than one substance. The substances that are stored in the packages adapted to store more than one substance must usually be removed from the package before they can be mixed together. The substances are typically removed from the package at the desired time and then placed in some form of container where the substances are mixed together.

Removing the substances from the package can be problematic because many packages are useless for storing the mixed substances once the substances are removed from the package. Therefore, the mixed substances must either be stored in the mixing container, or another package must be provided to store the mixed substances. The packages that are adapted to store more than one substance typically do not permit the substances to be mixed together within the package.

There are applications where it would be desirable to mix solid substances together to produce a gas. The substances in these types of applications are typically stored within one or more packages and then removed from the package(s) so that they can be mixed together within another container or package to produce a gas. The additional container and/or package typically does not include any means to permit the gas to be distributed throughout an area.

Accordingly, there is a need for a package that stores more than one substance. The package should allow an individual to readily mix the substances together within the package. A package that allows the substances to be mixed together within the package would eliminate (i) the labor required to remove the substances from the package; and (ii) the need for an extra container to mix the substances and/or a package to store the mixed substances. When the package is used to mix substances that produce a gas, the package should permit the gas to be spread throughout an area without having to remove the mixed substances from the package.

SUMMARY OF THE INVENTION

The present invention relates to a package that is capable of storing more than one substance within the package. The package allows a user to mix the substances together without removing them from the package. In one example application, solid substances are mixed together within the package in order to produce a gas.

In one aspect, the present invention relates to a package that includes an enclosure having a first substance and a second substance within the enclosure. The package further includes a plastic zipper which segregates the first substance from the second substance such that opening the plastic zipper allows the first substance and the second substance to be mixed together inside the enclosure. The package allows the first and second substances to be mixed together and stored within the enclosure without having to remove the substances from the package.

The package may further include an adhesive on an outer surface of the enclosure. The adhesive can be used to secure the package to an object. In some forms, a cover is detachably mounted on the adhesive such that the cover must be removed in order to expose the adhesive.

In another aspect, the present invention relates to a package that includes a gas-permeable enclosure and first and second solid substances sealed within the enclosure. The package further includes a mechanism that segregates the first solid substance from the second solid substance. Opening the mechanism allows a user to mix the first solid substance with the second solid substance inside the enclosure.

As an example, the package may be used to mix solid substances that produce a gas. The package is effective because the gas produced by mixing the first and second solid substances permeates through the enclosure for distribution throughout an area.

In some sample forms, the enclosure is formed of a first layer and a second layer and the package includes a first tab that is attached to an outer surface of the first layer and a second tab that is attached to an outer surface of the second layer. In addition, one, or both, of the first and second layers may be made of a gas-permeable material, such as a film formed with apertures.

In still another aspect, the present invention relates to a method of mixing substances within a package. The method includes segregating a first substance from a second substance where the first substance and the second substance are both inside an enclosure. The method further includes opening a plastic zipper that segregates the first substance from the second substance and mixing the first substance with the second substance inside the enclosure. In some sample forms, the method further includes adhering the enclosure to an object.

The method may also include forming the enclosure by attaching a first layer to a second layer, such as by sealing a perimeter of the first layer to a perimeter of the second layer. In some forms of the method, opening a plastic zipper that segregates the first substance from the second substance may include pulling a first tab that is mounted on an outer surface of the first layer away from a second tab that is mounted on an outer surface of the second layer.

In another aspect, the method of mixing substances within a package includes segregating a first solid substance from a second solid substance where the first and second solid substances are both inside of a gas-permeable enclosure. The method further includes opening a mechanism that segregates the first solid substance from the second solid substance and mixing the first solid substance with the second solid substance inside the gas-permeable enclosure. In one example method, mixing the first and second solid substances produces a gas, and the method further includes permeating the gas through the gas-permeable enclosure.

The purposes and features of the present invention will be set forth in the description that follows. Additional features of the invention will be realized and attained by the product and processes particularly pointed out in the written description and claims hereof, as well as from the appended drawings.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the invention.

BRIEF DESCRIPTION OF THE DRAWINGS

The present invention will be more fully understood, and further features will become apparent, when reference is made to the following detailed description and the accompanying drawings. The drawings are merely representative and are not intended to limit the scope of the claims. Like parts depicted in the drawings are referred to by the same reference numerals.

DETAILED DESCRIPTION OF THE INVENTION

In the following detailed description, reference is made to the accompanying drawings, which show specific embodiments in which the invention may be practiced. These embodiments are described in sufficient detail to enable those skilled in the art to practice the invention. It is to be understood that other embodiments may be utilized and structural changes made, such that the following detailed description is not to be taken in a limiting sense.

Figure 1:
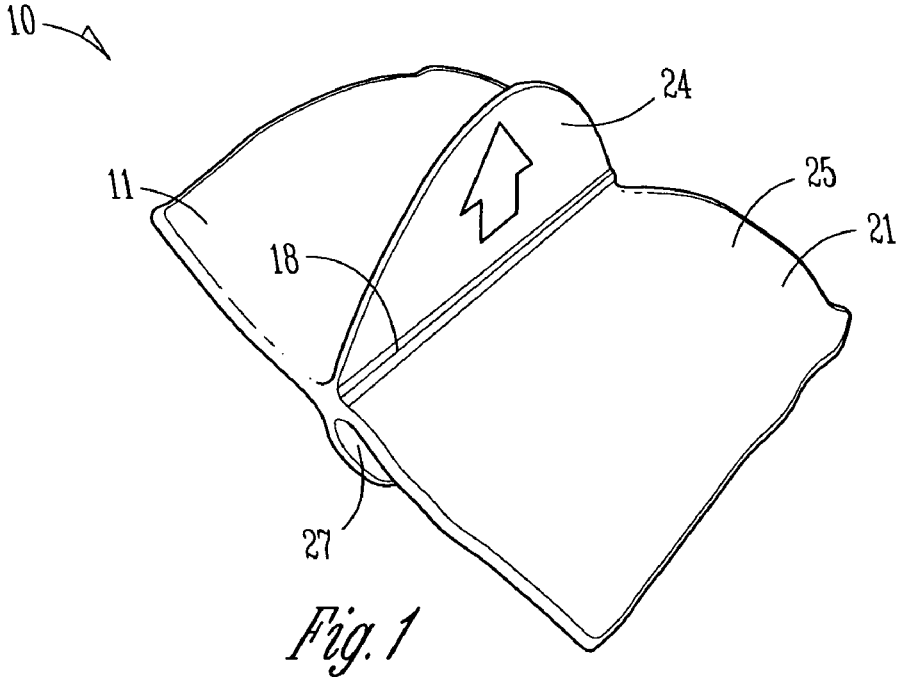
FIG. 1 is a perspective view of a package that segregates a first substance from a second substance.
Figure 2:
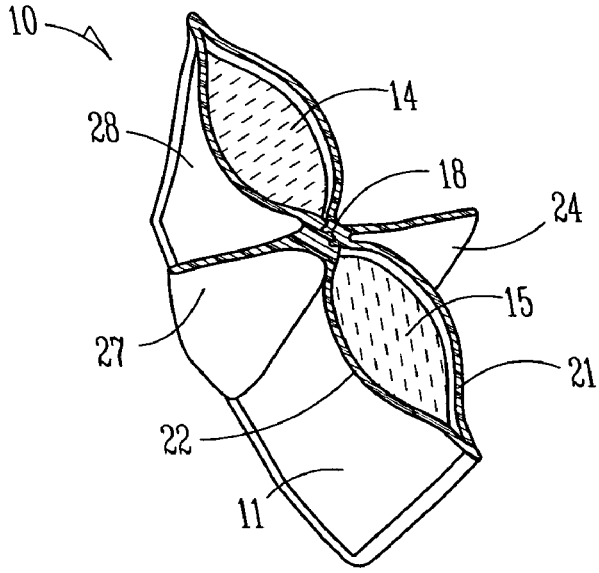
FIG. 2 is a perspective section view of the package shown in FIG. 1.
Figure 3:
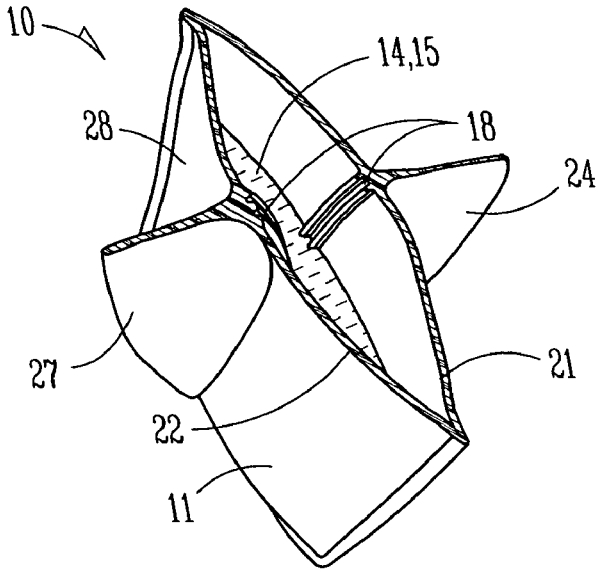
FIG. 3 is a perspective section view similar to FIG. 2 with the package open to allow mixing of the first substance with the second substance.

FIGS. 1–3 illustrate a package 10. The package 10 includes an enclosure 11 that stores a first substance 14 and a second substance 15 (see FIG. 2). The package 10 further includes a plastic zipper 18 that segregates the first substance 14 from the second substance 15 within the enclosure 11. Opening the plastic zipper 18 allows the first substance 14 and the second substance 15 to be mixed inside the enclosure 11 (see FIG. 3).

In the example package 10 illustrated in FIGS. 1–3, the enclosure 11 is formed of a first layer 21 and a second layer 22. The first and second layers 21, 22 each include a perimeter such that the perimeter of the first layer 21 is sealed to the perimeter of the second layer 22 to form the enclosure 11. Although the enclosure 11 may be made from any conventional material, the appropriate material for enclosure 11 will be determined by the type of substances that are stored within the enclosure 11. It should be noted that a portion of the enclosure 11 may be transparent to facilitate observing the degree of mixing between the first substance 14 and the second substance 15.

The first substance 14 may be a gas, liquid or solid and the second substance 15 may be a gas, liquid or solid. In some sample applications, mixing the first substance 14 with the second substance 15 produces a chemical reaction between the first substance 14 and the second substance 15 within the enclosure 11. As an example, at least one of the first and second layers 21, 22 may be partially formed of a gas-permeable material that permits a gas, which is formed by mixing the first and second substances 14, 15 together, to permeate through the enclosure 11.

The package 10 may further include a first tab 24 that is attached to an outer surface 25 of the first layer 21 and a second tab 27 that is attached to an outer surface 28 of the second layer 22. In the illustrated example package 10, the first tab 24 and the second tab 27 are adjacent to the plastic zipper 18.

Although plastic zipper 18 is shown as segregating the enclosure 11 into two compartments that are of equal size, plastic zipper 18 may segregate the enclosure 11 into compartments that are of unequal size, or into more than two compartments. The number, type and shape of the compartments will depend on the number and quantities of materials that need to be mixed together within the enclosure 11.

Figure 4:
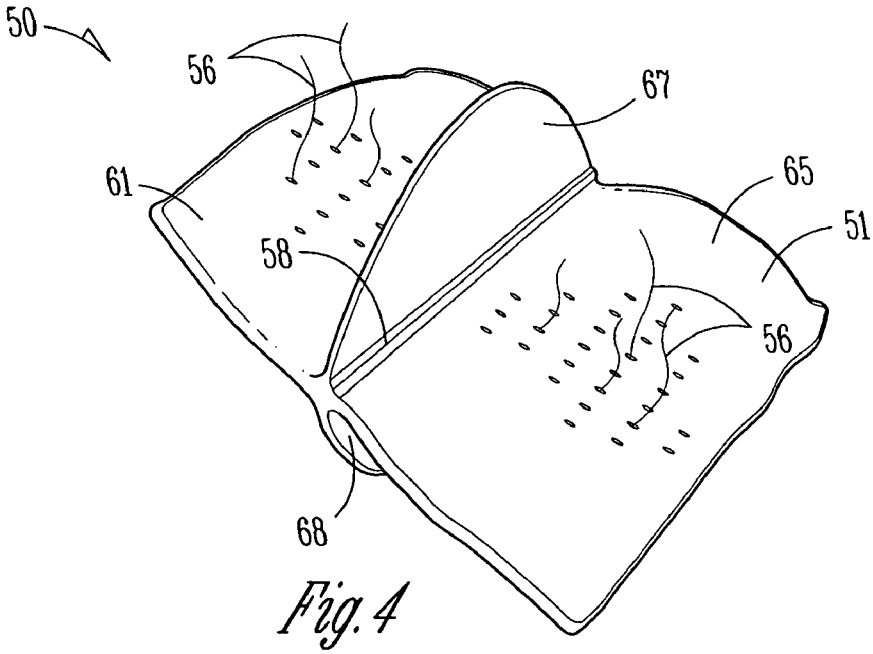
FIG. 4 is a perspective view of a package that segregates a first solid substance from a second solid substance.
Figure 5:
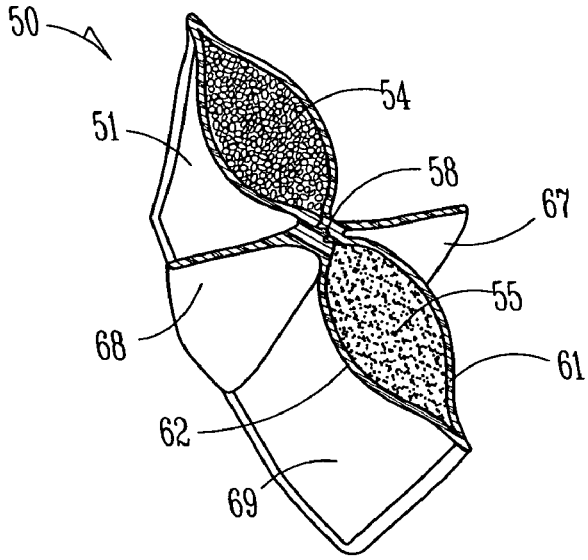
FIG. 5 is a section view of the package shown in FIG. 4.
Figure 6:
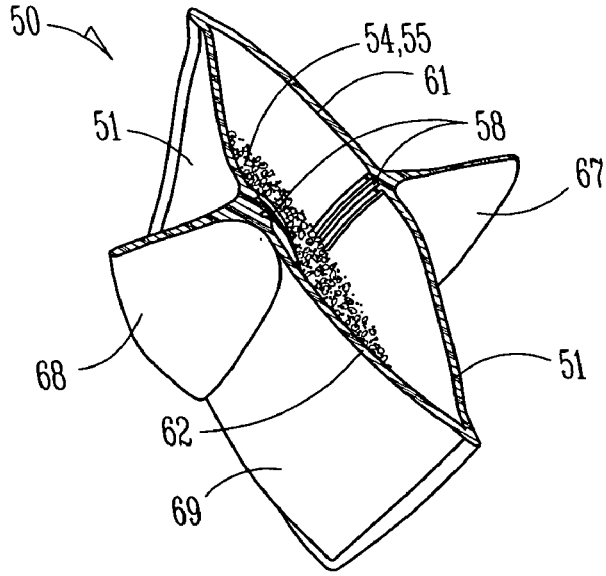
FIG. 6 is a section view similar to FIG. 5 with the package open to allow mixing of the first solid substance with the second solid substance.

FIGS. 4–6 illustrate another package 50. The package 50 includes a gas-permeable enclosure 51, and a first solid substance 54 and a second solid substance 55 that are stored within the enclosure 51 (see FIG. 5). The package 50 further includes a mechanism 58, such as a plastic zipper, that segregates the first solid substance 54 from the second solid substance 55. Opening the mechanism 58 allows the first solid substance 54 and the second solid substance 55 to be mixed together inside the gas-permeable enclosure 51 (see FIG. 6). The mechanism 58 may segregate the gas-permeable enclosure 51 into two compartments that are of equal size, unequal size, or into more than two compartments.

As an example, the first solid substance 54 includes ferric chloride and the second solid substance 55 includes sodium chlorite which produce a gas 56 (i.e., chlorine dioxide) when mixed together. At least one of the first solid substance 54 and the second solid substance 55 may be impregnated into zeolite particles to facilitate generating the gas 56. The gas-permeable enclosure 51 allows the gas 56, which is produced by mixing the first solid substance 54 with the second solid substance 55, to permeate through the gas-permeable enclosure 51.

The gas-permeable enclosure 51 may be formed of a first layer 61 and a second layer 62. In some forms of the package 50, the package 50 further includes a first tab 67 that is attached to an outer surface 65 of the first layer 61 and a second tab 68 that is attached to an outer surface 69 of the second layer 62.

It should be noted that only a portion of one, or both, of the first and second layers 61, 62 may be formed of a gas-permeable material, such as a film having apertures. In some example forms, a portion of the enclosure 51 may be transparent to facilitate observing the degree of mixing between the first solid substance 54 and the second solid substance 55.

Figure 7:
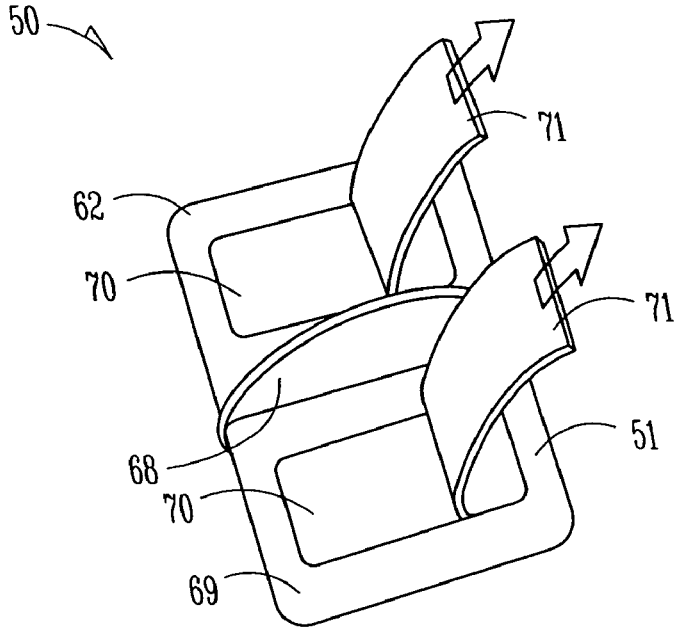
FIG. 7 is a perspective view of the package shown in FIG. 4 as covers are being removed from adhesive layers on the package.

FIG. 7 illustrates that package 50 may include an adhesive, such as adhesive layers 70, on at least one of the outer surfaces 65, 69 of the enclosure 51 (shown on outer surface 69 in FIG. 7). The package 50 may further include covers 71 that are detachably mounted onto the respective adhesive layers 70. Removing the covers 71 exposes the adhesive layers 70 and allows the package 50 to be secured to the object 75. Although two adhesive layers 70 are shown in FIG. 7, the number and size of the adhesive layers will depend on the size of the package as well as the application where the package is used.

Figure 8:
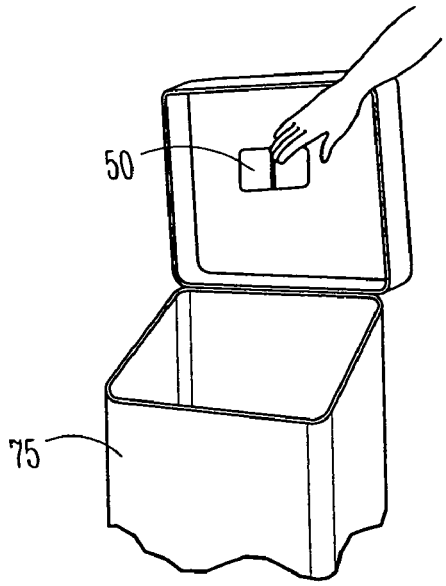
FIG. 8 is a perspective view of the package shown in FIG. 7 as the package is being mounted on an object.

FIG. 8 shows that the adhesive layers 70 may be used to secure the package 50 to an object 75, such as a garbage can lid. The package 50 may be used to control odors in the vicinity of the garbage can.

As an example, the mechanism 58 initially segregates ferric chloride from sodium chlorite within the enclosure 51.

Opening the mechanism 58 allows the ferric chloride and the sodium chlorite to be mixed together inside the enclosure 51. Mixing the ferric chloride with the sodium chlorite produces a gas 56 (i.e., chlorine dioxide) that permeates through the gas-permeable enclosure 51 to eliminate odors in the vicinity of the garbage can. At least one of the first solid substance 54 and the second solid substance 55 may be impregnated into zeolite particles to facilitate generating the gas 56.

A method of mixing substances within a package 10 is described herein with reference to FIGS. 1–3. The method includes segregating a first substance 14 from a second substance 15 where both the first and second substances 14, 15 are inside of an enclosure 11. The method further includes opening a plastic zipper 18 that segregates the first substance 14 from the second substance 15 and then mixing the first substance 14 with the second substance 15 inside the enclosure 11.

It should be noted that mixing the first and second substances 14, 15 inside the enclosure 11 may include mixing any combination of gas, liquid or solid substances. In one example form, ferric chloride that is impregnated into zeolite particles is mixed with sodium chlorite that is impregnated into zeolite particles to produce a gas (i.e., chlorine dioxide) such that the method further includes permeating the gas through the enclosure 11. It should be noted other materials may be mixed together inside the enclosure 11.

Mixing the first and second substances 14, 15 inside the enclosure 11 may include mixing substantially the same amounts of the first and second substances 14, 15. The number and quantity of the substances that are mixed together within the enclosure 11 is determined by the application where the package 10 is being used. In some sample forms, the first and second substances 14, 15 may chemically react to produce other types of gases, such as carbon dioxide.

The method may further include forming the enclosure 11 by attaching a first layer 21 to a second layer 22. In some forms of the method, attaching the first layer 21 to the second layer 22 includes sealing a perimeter of the first layer 21 to a perimeter of the second layer 22. In the illustrated example form of the method, the plastic zipper 18 is opened by pulling a first tab 24 that is mounted on an outer surface 25 of the first layer 21 away from a second tab 27 that is mounted on an outer surface 28 of the second layer 22.

Referring now also to FIGS. 4–8, the method may further include adhering the enclosure 11 (or 51) to an object 75. In some forms of the method, adhering the enclosure 11 (or 51) to an object 75 includes removing covers 71 from one or more adhesive layers 70 that are on an outer surface of the enclosure 11 (or 51).

Another method of mixing substances within a package will be described herein with reference to FIGS. 4–6. The method includes segregating a first solid substance 54 from a second solid substance 55 where the first and second solid substances 54, 55 are inside of a gas-permeable enclosure 51. The method further includes opening a mechanism 58, such as a plastic zipper, that segregates the first solid substance 54 from the second solid substance 55 and then mixing the first and second solid substances 54, 55 together inside the gas-permeable enclosure 51.

The method may be used to control odors such that mixing the first solid substance 54 with the second solid substance 55 produces a gas 56 that reduces odors. The gas 56 permeates through the gas-permeable enclosure 51 to expose the gas 56 to the odor. As an example, ferric chloride is mixed with sodium chlorite to produce chlorine dioxide. It should be noted that other substances may be mixed together to produce other types of gases (e.g., carbon dioxide).

The gas-permeable enclosure 51 may be formed by sealing a perimeter of a first layer 61 to a perimeter of a second layer 62. It should be noted that a portion of one, or both, of the first and second layers 61, 62 may be formed of a gas-permeable material.

As used herein, "plastic zipper" refers to plastic ziplocks, plastic zipper strips, plastic closures, and other plastic mechanisms that utilize a plastic zipper feature as a resealing element. In addition, the sizes and shapes of the packages described herein will depend on the applications where the packages will be used (among other factors).

The operations discussed above with respect to the described methods may be performed in a different order from those described herein. In addition, FIGS. 1–8 are representational and are not necessarily drawn to scale. Certain proportions thereof may be exaggerated, while others may be minimized.

The packages and methods described herein can be used to store more than one substance. The packages and methods segregate the substances yet allow the substances be to readily mixed together within the package thereby eliminating (i) the labor required to remove the substances from the package; and (ii) the need for an extra container to mix the substances and/or a package to store the mixed substances. Some example applications for the packages and methods described herein include mixing substances within the packages to provide thermal therapy, personal care, food products, pest control, disinfecting treatment and/or anti-microbial treatment.

The packages and methods may also be used to mix substances to produce a gas. The packages and methods permit the gas that is produced by mixing the substances to be spread throughout an area without having to remove the mixed substances from the package.

While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

We claim:

1. A package comprising:

a gas-permeable enclosure;

a first solid substance within said gas-permeable enclosure;

a second solid substance within said gas-permeable enclosure; and a resealable mechanism segregating said first solid substance from said solid second substance, wherein opening said mechanism allows mixing of said first solid substance with said second solid substance inside said gas-permeable enclosure, said gas-permeable enclosure allowing a gas that is produced by mixing said first solid substance with said second solid substance to permeate through said gas-permeable enclosure without rupturing said gas-permeable enclosure while retaining said first solid substance and said second solid substance within said gas-permeable enclosure.

2. The package of claim 1 wherein said gas-permeable enclosure is a film having apertures.

3. The package of claim 1 wherein said first solid substance includes ferric chloride impregnated into zeolite particles and said solid second substance includes sodium chlorite impregnated into zeolite particles.

4. The package of claim 1 wherein said enclosure is formed of a first layer and a second layer, and the package further comprises:

a first tab attached to an outer surface of said first layer; and a second tab attached to an outer surface of said second layer.

5. The package of claim 1 wherein a portion of said enclosure is transparent.

6. The package of claim 1 wherein said enclosure is formed of a first layer and a second layer.

7. The package of claim 6 wherein said first and second layers each include a perimeter, said perimeter of said first layer being sealed to said perimeter of said second layer to form said enclosure.

8. The package of claim 4 wherein said first tab and said second tab are adjacent said mechanism.

9. The package of claim 1 wherein said mechanism segregates said enclosure into two compartments that are of equal size.

10. The package of claim 1 wherein said mechanism is a plastic zipper.

* * * * *